US007628403B2

(12) United States Patent
Marx et al.

(10) Patent No.: US 7,628,403 B2
(45) Date of Patent: Dec. 8, 2009

(54) FENCING CARD GAME

(76) Inventors: Robert G. Marx, 7825 SW. 11th Ave., Portland, OR (US) 97219; Suzanne M. Marx, 7825 SW. 11th Ave., Portland, OR (US) 97219; Anthony G. D'Agnese, 188 Lupine La., Roseburg, OR (US) 97470; Susanne L. D'Agnese, 188 Lupine La., Roseburg, OR (US) 97470

( * ) Notice: Subject to any disclaimer, the term of this patent is extended or adjusted under 35 U.S.C. 154(b) by 160 days.

(21) Appl. No.: 12/027,946

(22) Filed: Feb. 7, 2008

(65) Prior Publication Data

US 2008/0284101 A1 Nov. 20, 2008

Related U.S. Application Data

(63) Continuation of application No. 10/908,154, filed on Apr. 28, 2005, now abandoned.

(51) Int. Cl.
*A63F 1/00* (2006.01)

(52) U.S. Cl. ..... 273/308; 273/292

(58) Field of Classification Search ..... 273/292, 273/308, 255, 262, 259, 244–247, 277
See application file for complete search history.

(56) References Cited

U.S. PATENT DOCUMENTS

| | | | | |
|---|---|---|---|---|
| 1,322,954 | A | 11/1919 | Rosenfeld | |
| 1,404,599 | A | 1/1922 | Glenny | |
| 1,640,261 | A | 8/1927 | Whaley et al. | |
| 4,861,031 | A | 8/1989 | Simms | |
| 5,040,796 | A | 8/1991 | Schall | |
| 5,662,332 | A * | 9/1997 | Garfield | 273/308 |
| 5,954,332 | A * | 9/1999 | Mero et al. | 273/236 |
| 6,209,873 | B1 * | 4/2001 | DeGeorge | 273/262 |
| 6,322,077 | B1 * | 11/2001 | Braunlich et al. | 273/292 |
| 6,554,702 | B2 | 4/2003 | Mahar et al. | |
| 6,601,851 | B1 * | 8/2003 | Sakamoto et al. | 273/308 |
| 6,623,010 | B1 * | 9/2003 | Holland, Jr. | 273/292 |
| 6,893,021 | B1 * | 5/2005 | Gress | 273/298 |
| 7,384,340 | B2 * | 6/2008 | Eguchi et al. | 463/43 |
| 2003/0094759 | A1 | 5/2003 | Niedner et al. | |
| 2004/0046319 | A1 | 3/2004 | Merritt, III | |

OTHER PUBLICATIONS

S. O'Sullivan, "En Garde from Abacus Spiele," http://www.panix.com/~sos/bc/engarde.html, 3 pages, printed Apr. 16, 2003.

En Garde, game info, from Brikker & Brett, http://www.brikkerogbrett/games/engarde.shtml, 3 pages, printed Apr. 16, 2003.

(Continued)

*Primary Examiner*—Benjamin H Layno
(74) *Attorney, Agent, or Firm*—Joseph P. Curtin, L.L.C.

(57) ABSTRACT

A fencing match is simulated by a card game that includes a plurality of action cards and a plurality of judgment cards. Each action card includes an indication of a movement distance, a reach distance and a relative strength of an action. Each judgment card includes an indication of a successful play, an unsuccessful play or a penalty. Each action card also includes an indication of a type of movement and a direction of movement that is associated with the movement distance, the reach distance and the relative strength, and whether the type of movement is an offensive movement or a defensive movement.

19 Claims, 10 Drawing Sheets

OTHER PUBLICATIONS

En Garde, pictures of the game, http://www.brikkerogbrett.com/games/engarde2.shtml, 3 pages, printed Apr. 16, 2003.
Brikker & Brett, http://games.brikkerogbrett.com/, 2 pages, printed Apr. 16, 2003.
Fencing Booth—Introduction, http://www.isd.net/fencing/index.html, 2 pages, printed Apr. 16, 2003.
Fencing Booth—Fencing Rules, http://www.isd.net/fencing/rules.html, 5 pages, printed Apr. 16, 2003.
A Card-based Duelling System, http://www.idiom.com/~trip/gaming/homebrew/cards.html, 2 pages, printed Apr. 16, 2003.
Center Court, http://www.gis.net/~pldr/CC.html, 3 pages, printed Apr. 16, 2003.

* cited by examiner

202

201

204

203

205

503

502

501

504

502

501

FENCING CARD GAME

CROSS-REFERENCE TO RELATED APPLICATION

The present patent application is a continuation patent application of U.S. patent application Ser. No. 10/908,154, filed Apr. 28, 2005, entitled "Fencing Card Game," and invented by Robert G. Marx et al., the disclosure of which is incorporated by reference herein.

BACKGROUND OF THE INVENTION

1. Field of the Invention

The present invention relates to card games. More particularly, the present invention relates to a card-based game that simulates a combative sporting event.

2. Description of the Related Art

Sports-based card games are well known. For example, U.S. Pat. No. 1,322,954 to Rosenfeld, U.S. Pat. No. 1,404,599 to Glenny and U.S. Pat. No. 1,640,261 to Whaley et al. each disclose a card game simulating a boxing match. U.S. Pat. No. 4,861,031 to Simms discloses a competitive card wrestling game that simulates a competitive wrestling match. U.S. Pat. No. 5,040,796 to Schall discloses a card-based game that simulates a football game. More recently, another card game, entitled "En garde," has been developed to simulate a fencing match.

BRIEF SUMMARY OF THE INVENTION

The present invention provides a card-based game that simulates a fencing match.

In that regard, the present invention provides a card game having a plurality of action cards and a plurality of judgment cards. Each action card includes an indication of movement distance, reach distance and relative strength. Each judgment card includes an indication of a successful play, an unsuccessful play or a penalty. Each action card also includes an indication of a type of movement and a direction of movement that is associated with the movement distance, the reach distance and the relative strength, and whether the type of movement is an offensive movement or a defensive movement. In one exemplary embodiment, the card game simulates a fencing bout. In another exemplary embodiment, the card game simulates a boxing match. In yet another exemplary embodiment, the card game simulates a martial arts match, such as a simulated judo match, a simulated karate match or a simulated Tae Kwan Do match.

The present invention also provides a method of playing a card game in which at least one action card is selected from a first group of action cards. Each action card that is played is played as an offensive action. According to the present invention, each action card played includes an indication of a movement distance, an indication of a reach distance and an indication of a relative strength of the offensive action. A reply action card selected from a second group of action cards and played in response to the offensive action. The reply action card includes an indication of a movement distance, an indication of a reach distance and an indication of a relative strength in response to the offensive action. Each action card and each reply action card also includes an indication of a type of movement and a direction of movement that is associated with the movement distance, the reach distance and the relative strength, and whether the type of movement is an offensive movement or a defensive movement.

A result of playing each offensive action card and the reply action card is then determined. The result is based on at least one of a distance of separation resulting from the indication of the movement distance of each action card played as an offensive action and the indication of the movement distance of the reply action card, the indication of the reach distance on an action card played as an offensive action, and a difference in the indication of the relative strength of the offensive action on an action card played as an offensive action and the indication of the relative strength on the reply action card.

The game continues by repeatedly playing at least one action card as a subsequent offensive action, playing a corresponding reply action card in response to the subsequent offensive action and determining the results of playing each offensive action card and the reply action card. A judgment card is selected from a third group of cards to determine the outcome when the indication of relative strength on one of an action card played as an offensive action and the corresponding reply action card is greater than the indication of strength on the correspondingly played action card and the distance of separation resulting from the indication of the movement distance of each action card played as an offensive action and the indication of the movement distance of the corresponding reply action card is less than a predetermined distance. Each judgment card of the third group of cards includes an indication of at least one of a successful play, an unsuccessful play or a penalty.

BRIEF DESCRIPTION OF THE DRAWINGS

The present invention is illustrated by way of example and not by limitation in the accompanying figures in which like reference numerals indicate similar elements and in which.

DETAILED DESCRIPTION OF THE INVENTION

The present invention is a card-based game that uses two decks of cards, an Action deck and a Referee deck, for simulating attacks and responses that would normally be expected in an actual fencing bout. The cards in the Action deck are used to simulate a move that is close enough to an opponent so that the opponent can be reached with sufficient strength to score a touch. The cards in the Referee deck are used for determining the validity of a touch that has been scored and for determining whether a penalty is assessed. Tournament play for more than two fencers can be simulated using multiple decks in pools or a direct-elimination format.

As used herein, the terms "player," "attacker," "defender," "fencer," and "opponent" generally indicate a participant playing the game of the present invention. In particular, the terms "player" and "fencer," as used herein, generally refer to a game participant. The term "attacker," as used herein, generally refers to a game participant that is initiating an offensive fencing movement. The terms "defender" and "opponent," as used herein, generally refer to a game participant that defends or responds to an offensive or a defensive fencing move initiated by the other a player.

The Action Deck

Figure 1:
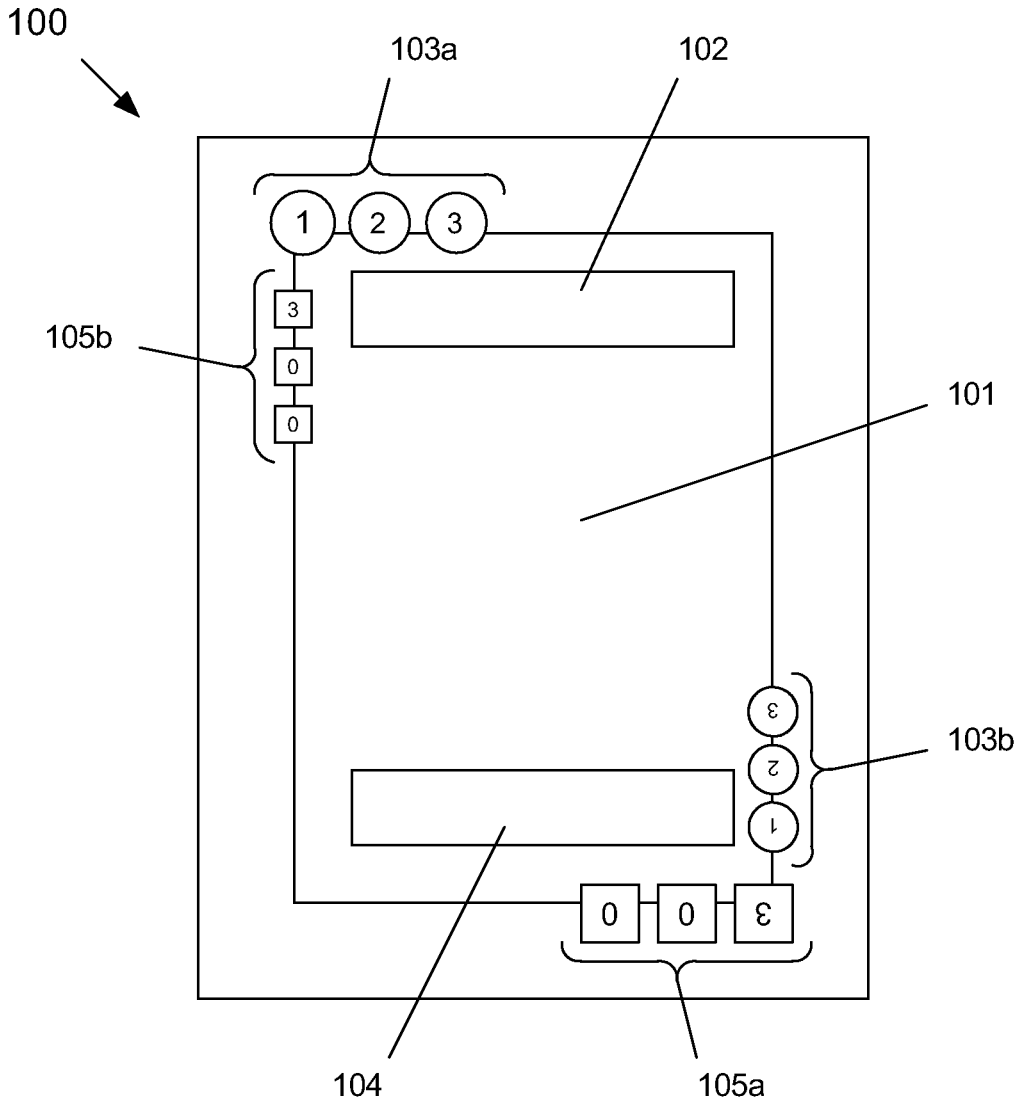
FIG. 1 depicts an exemplary format for an Action card according to the present invention.
Figure 2B:
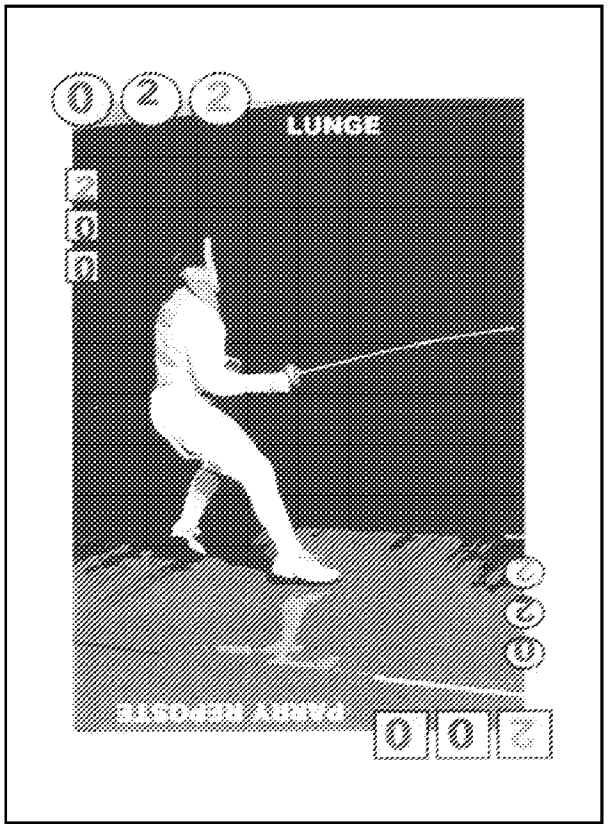
FIGS. 2A-2E respectively depict exemplary Action cards according to the present invention.
Figure 2A:
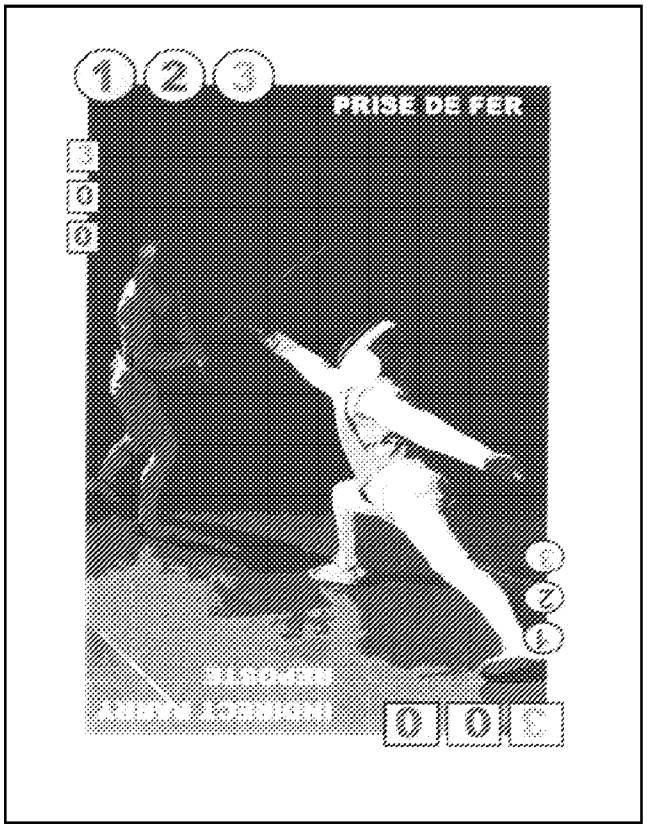
Figure 2D:
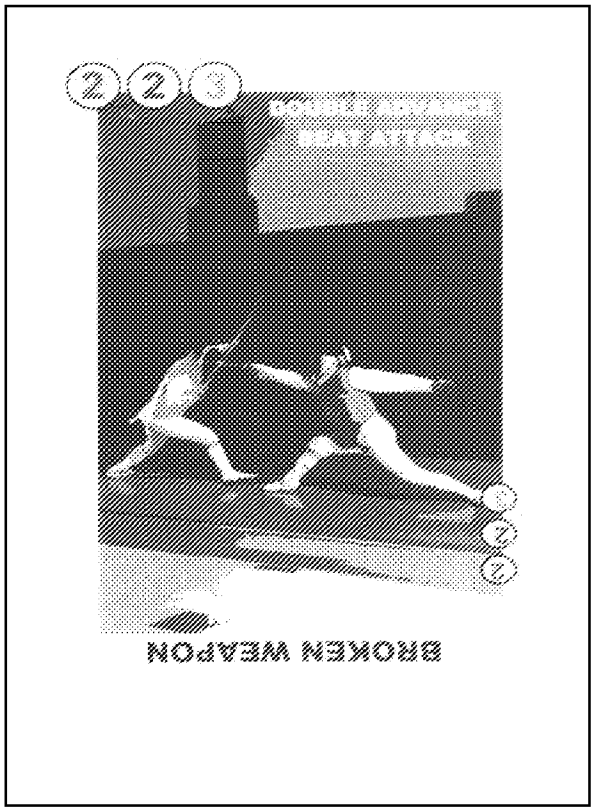
Figure 2C:
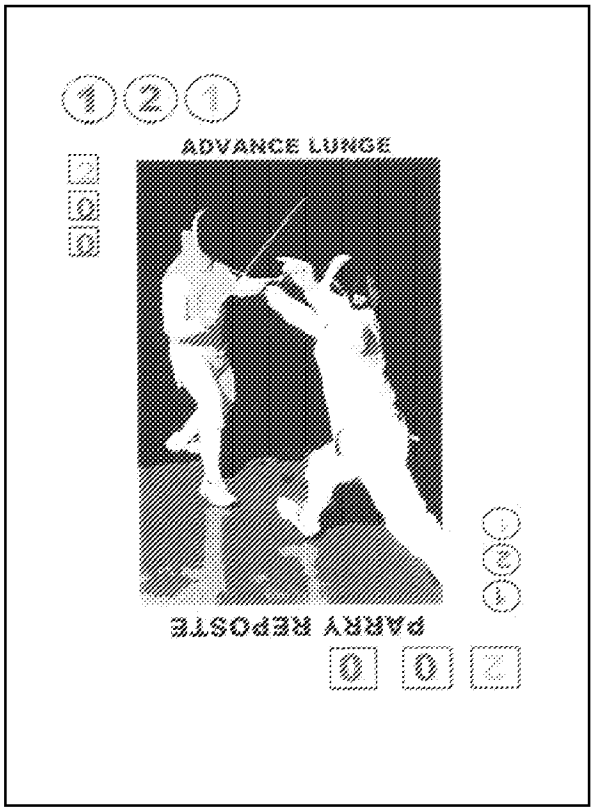
Figure 2E:
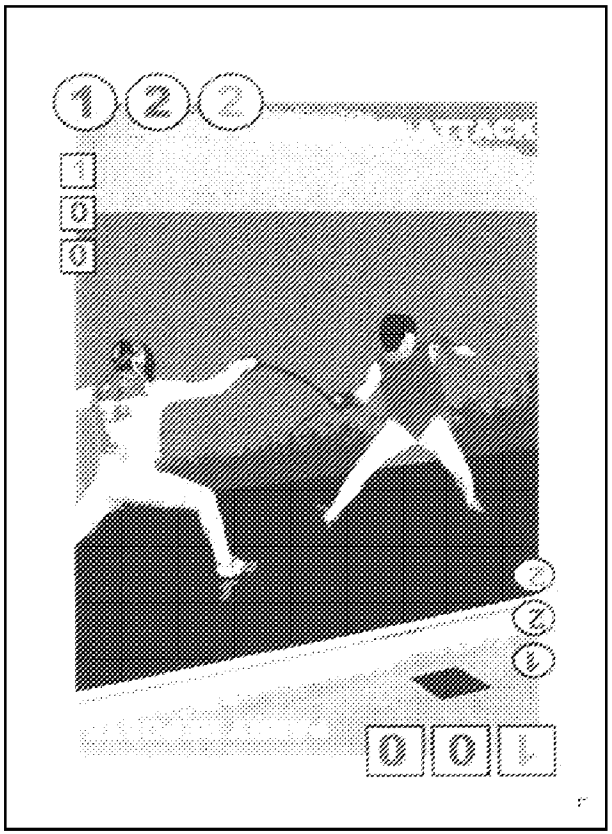

The majority of the Action cards forming the Action deck depict both an offensive and defensive fencing move. Some Action cards also include special narrative instructions. FIG. 1 depicts an exemplary format for an Action card 100. Action card 100 includes a region 101 that illustrates a fencing move, a region or field 102 that identifies the offensive fencing move, regions or fields 103*a* and 103*b* that set forth numerical quantities associated with elements characterizing the offensive fencing move, a region or field 104 that identifies the defensive fencing move, and regions or fields 105*a* and 105*b* that set forth numerical quantities associated with elements characterizing the defensive fencing move. FIGS. 2A-2E respectively depict exemplary Action cards 201-205.

Exemplary offensive fencing moves that can be identified in region 102 include, but are not limited to, prise de fer, advance, lunge, advance lunge, double advance beat attack, and compound attack. Exemplary defensive fencing moves that can be identified in region 104 include, but are not limited to, indirect parry reposte, parry reposte, parry reposte retreat and yielding parry.

When an Action card includes special narrative instructions, the special narrative instructions can be in addition to an identified offensive or defensive fencing move respectively in regions 103 and 105, or as an alternative to an identified offensive or defensive fencing move. Exemplary special narrative instructions include, but are not limited to broken weapon—halts attack.

The offensive fencing move and the defensive fencing move identified on an Action card each have three move elements characterizing the fencing move with respect to a distance of the move, a reach associated with the move and a strength associated with the move. The quality or magnitude of a move element is represented by a numerical value. The units for both a distance element and a reach element are the same and are referred to herein as distance or reach units. The unit for a strength element is a relative strength. The move elements characterizing a fencing move on an Action card are generally different from the move elements characterizing the fencing move on another Action card. Depending on the particular fencing move, the numerical values for a corresponding move element can vary between negative and positive numbers and can be equal to zero.

For example, Action card 100 in FIG. 1 has three move elements for both the offensive and defensive fencing move. In particular, move elements corresponding to the offensive fencing move are indicated by numbers within circles at regions 103*a* and 103*b*. In region 103*a*, the first, or left-most, move element corresponds to the distance element for the offensive fencing move. The second, or middle, move element corresponds to the reach element, and the third, or right-most, move element corresponds to the strength element. For this example, the distance element for the offensive defensive move has a numerical value of 1, the reach element has a numerical value of 2, and a strength value of 3. The move elements in region 103*b* are oriented upside down with respect to the move elements in region 103*a* so that the offensive fencing move elements are easily read depending on how the Action card is played.

The move elements corresponding to the defensive fencing move of Action card 100 are indicated by numbers within squares are regions 105*a* and 105*b*. In region 105*a*, the first, or right-most, move element (viewed upside down in FIG. 1) corresponds to the strength element for the defensive fencing move. The second, or middle, move element (viewed upside down in FIG. 1) corresponds to the reach element, and the third, or leftmost, move element (viewed upside down in FIG. 1) corresponds to the distance element. For this example, the strength element for the defensive fencing move has a numerical value of 3, the reach element has a numerical value of 0, and a distance value of 0. The move elements in region 105*b* are oriented upside down with respect to the move elements in region 105*a* so that the offensive fencing move elements are easily read depending on how the Action card is played.

It should be understood that the placement of move elements on an Action card could be anywhere, regardless whether the move is an offensive or defensive fencing move. Additionally, it should be understood that the arrangement or order of move elements for a fencing move can be different from the arrangement depicted in FIG. 1. Further still, it should be understood that shapes other than the circular and square shapes respective used for offensive and defensive fencing moves and that are depicted in FIG. 1 could be used. Additionally or alternatively, colors could be used for indicating particular move elements are associated with an offensive or a defensive fencing move. For example, in one exemplary embodiment of the present invention, the distance element of a move could be printed in red, the reach element could be printed in blue and the strength element could be printed in green. It should be understood that other colors could alternatively be used for depicting the respective move elements. Further still, it should be understood that two decks of Action cards could be used in which one deck contains Action cards depicting offensive fencing moves and the other deck contains Action cards depicting defensive fencing moves.

During play, only one Action card is played at a time by a player unless the Action card is accompanied by another Action card having only a distance element, that is, an Action card in which the reach and strength element values both equal 0. Each Action card can only be played once using either the offensive or defensive fencing move depicted on the card.

The Referee Deck

Figure 3:
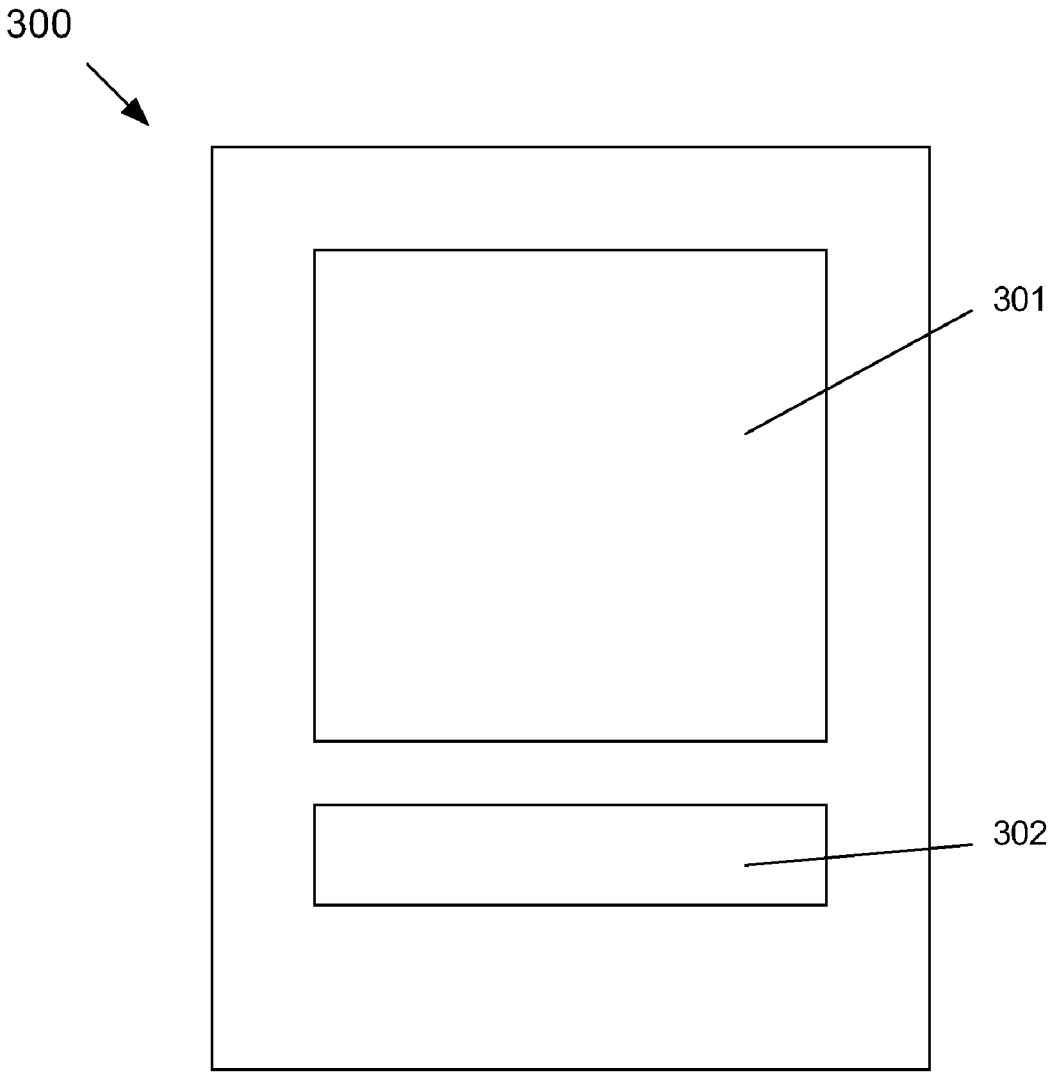
FIG. 3 depicts an exemplary format for a Referee card according to the present invention.
Figure 4A:
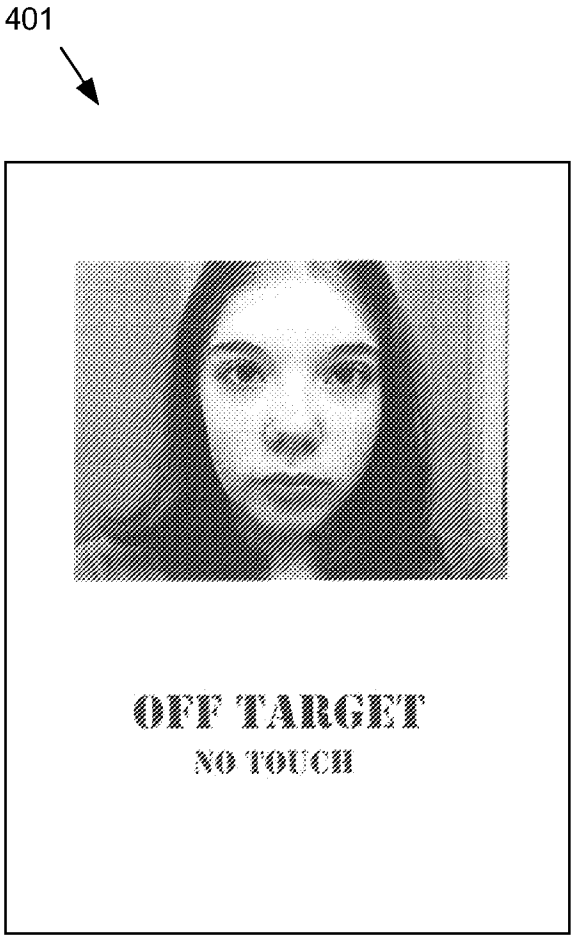
FIGS. 4A-4C respectively depict exemplary Referee cards according to the present invention.
Figure 4B:
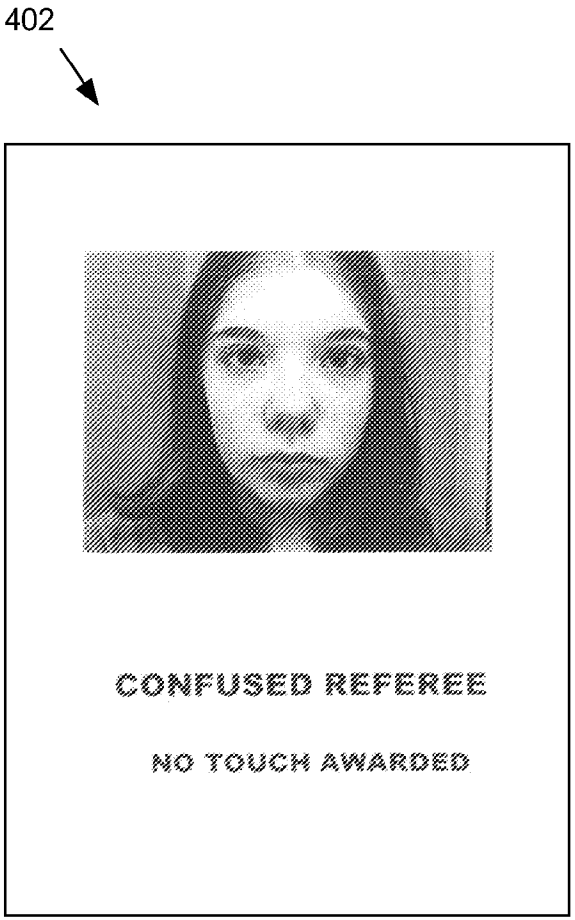
Figure 4C:
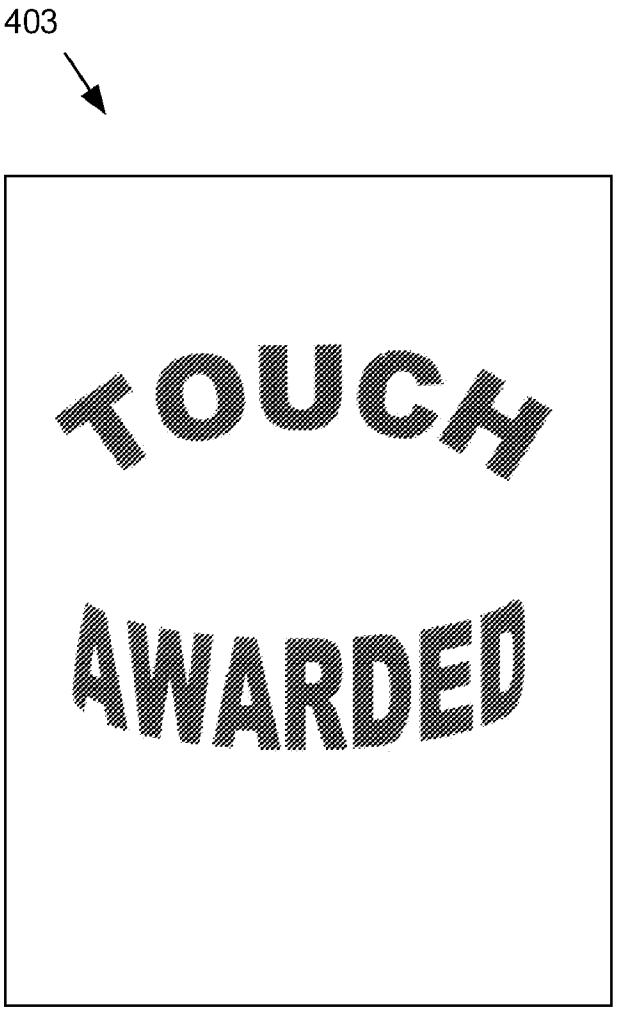

The Referee deck is used for determining the validity of a touch that has been scored and for determining whether a penalty is to be assessed. In normal play, the fencer scoring a touch turns over the top card on the Referee deck to reveal a referee's decision regarding whether the touch is awarded, the referee's view of the action, or whether one or more penalties are assessed. FIG. 3 depicts an exemplary format for a Referee card 300 that includes a region or field 301 that can contain in image of a referee or a description of a referee's decision, and an optional region or field 302 that can contain a description of the referee's decision. FIGS. 4A-4C respectively depict exemplary Referee cards 401-403 having a referee's decision. Other Referee cards that are not shown can be yellow and red.

Special Referee cards have a narrative description that accordingly supersedes any of the game rules. Each subsequent yellow card received by a fencer after the fencer has received a yellow card results in a touch for the fencer's opponent. Each red penalty card received by a fencer results in a touch for the fencer's opponent. A fencer receiving a penalty retains the penalty card. Touches are counted by retaining touch-awarded cards. Alternatively, score could be kept on a score sheet.

Description of Play

The fencing card game according to the present invention begins by determining which player deals first, such as by flipping a coin. An alternatively technique that could be used for determining which player deals first could be based on, for example, the relative ages of the players or a roll of a die. For each hand played, the dealer is defined as the attacker. The other player is defined as the defender. The attacker separately shuffles both the Action and Referee decks and offers both decks to the defender to cut. Once both decks are cut, the attacker deals six (6) Action cards face down to each fencer. The Action cards are kept secret until played.

The players start with a distance separating each fencer of four (4) distance units. The attacker plays the first Action card face up between the fencers starting from the attacker's left (i.e., the dealer's left). An Action card, when played, can be employed as an offensive or a defensive move. Offensive distance values move a fencer towards an opponent, while defensive values move a fencer away from an opponent. Each move is played pointing the move type depicted on an Action card towards the opponent. That is, when the move played is an offensive fencing move, the offensive fencing move portion of the Action card is played oriented toward the opponent. For example, fields 102 and 103*a* depicted in FIG. 1 are played oriented toward the attacker's opponent. Similarly, when the move played is a defensive fencing move, the defensive move portion of the Action card is played oriented toward the opponent. For example, fields 104 and 105*a* depicted in FIG. 1 are played oriented toward the defender's opponent. When an Action card is played, it cannot be picked up.

The distance element of the Action card affects the distance between the two fencers. The reach element indicates the reach of the fencer playing the Action card. Once a fencer is close enough to hit (i.e., reach) the opponent, an attack can be launched. When an attack is launched that reaches the opponent, the opponent has an opportunity to defend the attack using defensive moves indicated on Action cards in the opponent's possession. Only defensive fencing moves having strength values that are equal to or greater than the strength value of the last-played offensive Action card of an attacker will defend the offensive action.

When the defensive strength is equal to the attacker's offensive strength, the offensive action is neutralized and fencing continues at the current distance. When the defensive strength exceeds the offensive strength, the fencing phrase continues using defensive fencing moves until a strength value cannot be exceeded or neutralized, or there is a change of distance.

When the reach of the offensive move equals the distance between the players, the offensive move cannot be defended. The opponent cannot play an Action card as a defensive move, and the top card of the Referee deck is then drawn. An offensive move that is made with a distance change of any amount or when the reach is not the exact distance apart can be defended with a defensive move. An offensive move in which the reach goes past the opponent counts as a potential touch and must be defended or a touch is awarded. When there is a distance change caused by a defensive move, the opponent (i.e., the attacker) of the defensive move may play an offensive move, but if the opponent of the defensive move responds with a defensive move, the opponent of the defensive move must have the necessary reach to score. When distance between the two fencers becomes 0, the phrase may continue until a touch is scored or the strength value is neutralized. When opponents are at a distance of 0 distance units and the strength has been neutralized, the opponents are separated back to a distance of 4 distance units, the deal changes hands, Action cards are dealt so each fencer has six (6) cards and the bout continues. Alternatively, the number of cards that are dealt to each fencer could be different for this situation.

When play forces a distance that moves a player past an opponent, that is, a distance less than 0, the strength still counts and the opponent can only play one Action card to neutralize or defend the action. Regardless whether a valid touch is scored or neutralized, the fencers are separated back to a distance of 4, the deal changes hands, cards are dealt to each fencer until each has six cards, and the bout continues.

A touch can be awarded when a fencer is touching their opponent and the opponent does not have a card that would defend the offensive action. In particular, the distance between two players must be less than or equal to the values of the distance and reach of the played Action cards. A perfect offensive move is made with reach only such that the distance between the players remaining unchanged.

At any time during a phrase, a fencer can call touche (acknowledge a touch) or may choose to play an Action card that neither neutralizes nor exceeds the strength of the offensive move, which halts the action. Playing an Action card that neither neutralizes nor exceeds the strength of the offensive action can be used to dispose of weak Action cards. The fencer whose action scores a touch turns over the top card of the Referee deck for a Referee's decision regarding the validity of a touch.

When a player runs out of Action cards during play, the player runs out of moves. The player's opponent can continue to play Action cards until the opponent scores or wishes to stop.

When all Action cards have been played and no touches have been scored, the fencers are separated to a distance of four (4) distance units and the deal changes hands. The new dealer deals six (6) Action cards to each fencer and the bout continues.

Examples of Play

Figure 5A:
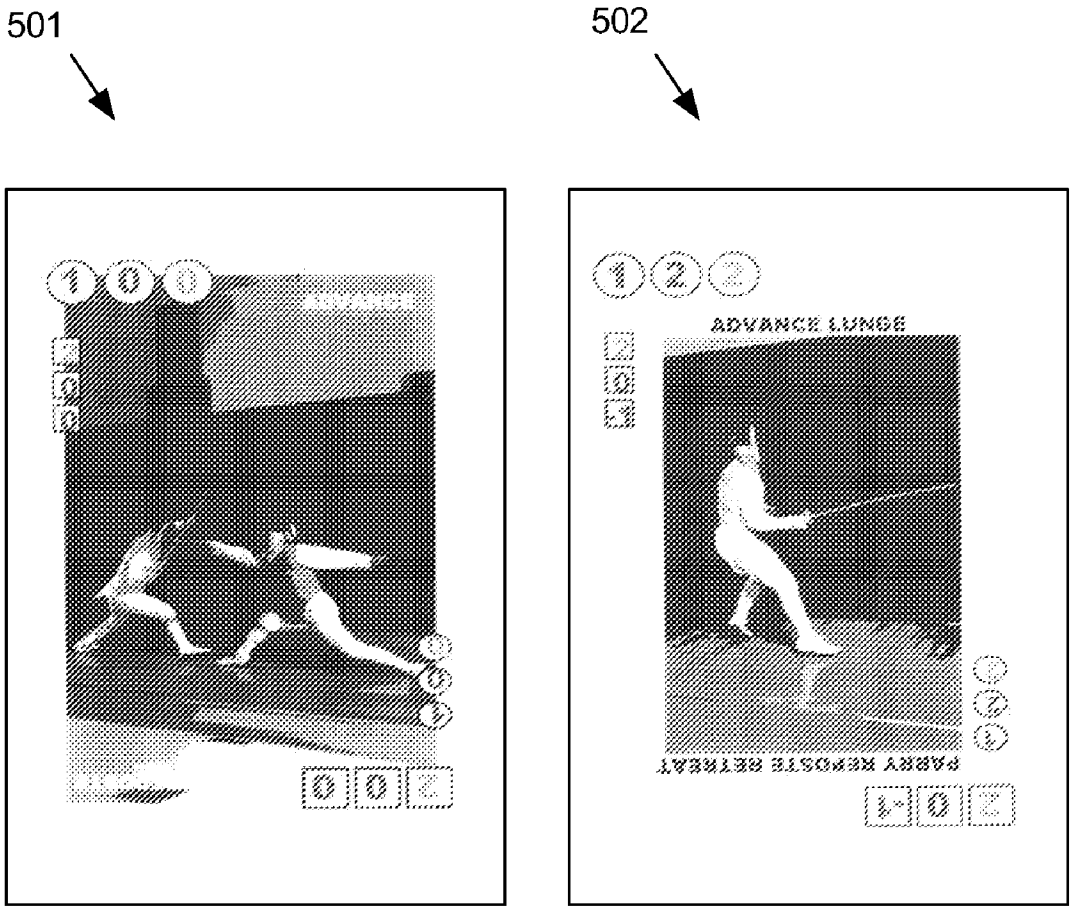
FIGS. 5A-5C depict exemplary sequences of play according to the present invention.
Figure 5B:
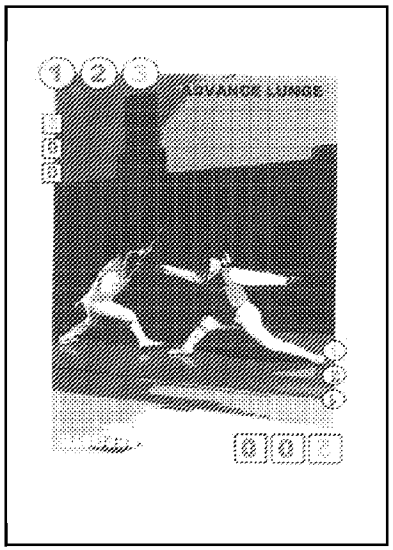
Figure 5B:
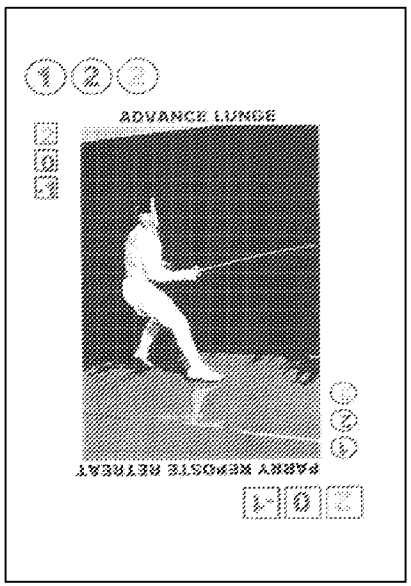
Figure 5B:
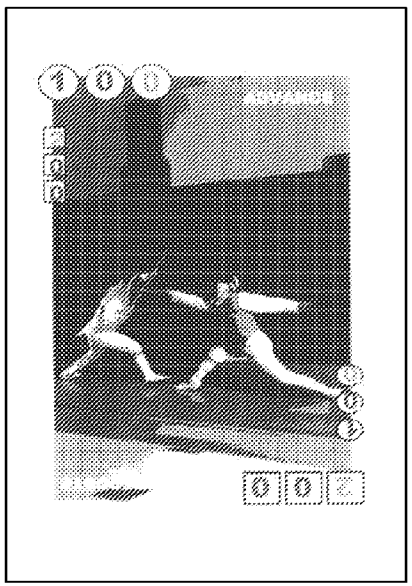
Figure 5C:
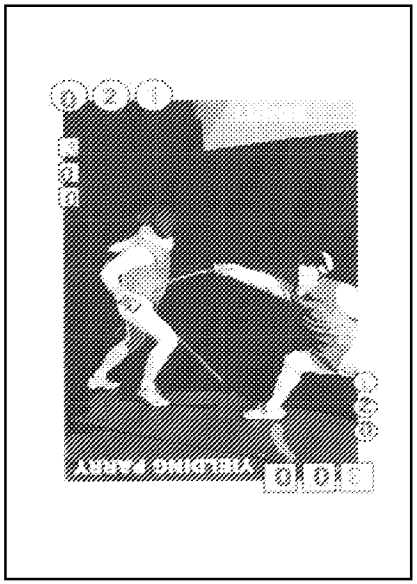
Figure 5C:
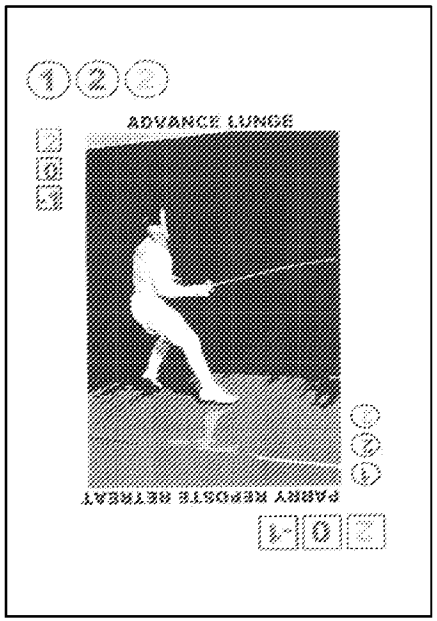
Figure 5C:
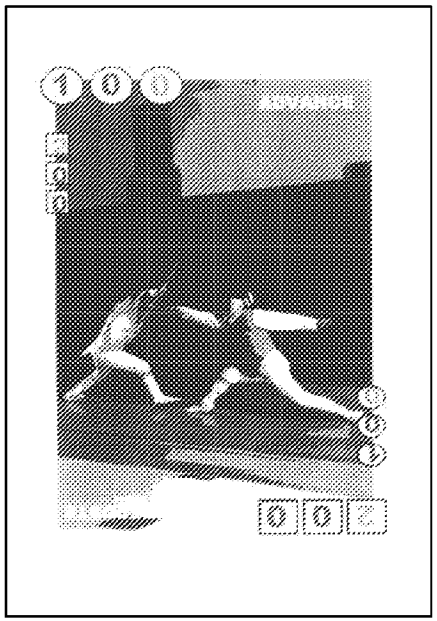

FIGS. 5A-5C depict two exemplary scenarios of play according to the present invention. The first exemplary scenario of play is depicted by FIGS. 5A and 5B and the second exemplary scenario of play is depicted by FIGS. 5A and 5C. For both exemplary scenarios of play, the fencers begin a distance of four (4) distance units apart.

In the first exemplary scenario of play, the attacker plays two Action cards 501 and 502, as depicted in FIG. 5A. The first Action card 501 has for the offensive fencing move a distance element value of 1, a reach element of 0 and a strength element of 0. The second Action card 502 has for the offensive fencing move a distance element value of 1, a reach element of 2, and a strength element of 2. The result of playing cards 501 and 502 is that the fencers are separated by a distance of 2 and the attacker is now hitting his opponent with a strength value of 2 because the reach of the attacker is 2. The attacker must announce the move and the strength with which the attacker is hitting the opponent. For example, the attacker would announce "I am hitting with a strength of 2 at a distance of 2."

FIG. 5B depicts the continuation of the first exemplary scenario of play. In particular, the defender plays an Action card 503 having a defensive fencing move with a strength element value of 2 that neutralizes the offensive move created by the combination of Action cards 501 and 502. Play now continues with the attacker now playing another Action card at the new distance of 2.

Alternatively, as the second exemplary scenario of play, if the defender had played an Action card having a defensive strength element value of 3, such as depicted by Action card 504 in FIG. 5C, the phrase continues. The defender is now hitting the attacker with a strength element value of 1, that is, the difference between the two strengths element values of the offensive and defensive actions played. The defender then would announce "I am hitting you with a strength of 1." At this point, the attacker must use a defensive move to either neutralize or exceed the touching strength. If the attacker cannot neutralize or exceed the touching strength, the attacker is touched by the defender.

In the case that the attack was neutralized or exceeded, the phrase continues until (1) an Action card cannot be neutralized or exceeded, (2) one of the fencer calls touche or (3) the players run out of actions and are unable to play.

When a touch has been achieved, the fencer winning the touch draws the top card off the Referee deck to reveal the Referee's decision regarding the validity of the touch. Once a touch has been awarded (i.e., valid), the played Action cards are removed from the playing space, a coin is again flipped or an alternative technique is used to determine the attacker, and the remaining Action deck is handed to the new attacker who deals enough cards to each player until each player has six (6) cards each, without shuffling the cards. The bout then continues as before.

Each fencer keeps their touch-awarded cards for keeping score or uses a score sheet. The first fencer scoring five (5) touches wins the bout. Each fencer is responsible for keeping track of the current distance, reach, and strength. When a mistake is made in announcing the distance, reach or strength, an opponent can take advantage of the error or can correct the error only at time of play. In normal play, a fencer receiving five valid touches wins a bout.

While the present invention has been described in terms of a fencing match, the present invention is not so limited. For example, an alternative embodiment of the present invention could be a card-based game simulating a boxing match and with the offensive and defensive actions relating to boxing actions. Accordingly, the values of the move elements would correspond to offensive and defensive boxing actions. Another alternative embodiment of the present invention could be a card-based game simulating a martial-arts match, such as a judo match, a karate match or a Tae Kwan Do match, with the values of the move elements corresponding to offensive and defensive martial-art actions.

A portion of the disclosure of this patent document contains material which is subject to copyright protection by the copyright owner, Fencers on Deck LLC, successors and assigns (the "copyright owner"). The copyright owner has no objection to the facsimile reproduction by anyone of the patent document or the patent disclosure, as it appears in the Patent and Trademark Office patent file or records, but otherwise reserves all copyright rights whatsoever.

Although the foregoing invention has been described in some detail for purposes of clarity of understanding, it will be apparent that certain changes and modifications may be practiced that are within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of playing a card game, the method comprising:

providing a physical group of action cards and a physical group of judgment cards;

playing at least one action card selected from a first group of action cards, each action card played being selected from the first group of action cards and being played as a first action, and each action card selected from the first group of action cards comprising at least one of an indication of a required movement distance for the first action, an indication of a reach distance for the first action and an indication of a relative strength of the first action;

playing at least one reply action card selected from a second group of action cards in response to a total number of action cards played for the first action, each reply action card comprising at least one of an indication of a required movement distance for the reply action, an indication of a reach distance for the reply action and an indication of a relative strength of the reply action in response to the first action;

determining a result of playing each first action card and each corresponding reply action card, the result being based on at least one of (1) a distance of separation resulting from the indication of the movement distance of each action card played as the first action and the indication of the movement distance of each reply action card played in response to the first action, (2) the indication of the reach distance on a selected action card played as the first action, (3) the indication of the reach distance on a selected reply action card played in response to the first action, and (4) a difference in the indication of the relative strength of a selected action card played as the first action and the indication of the relative strength on a selected reply action card played in response to the first action;

repeatedly playing at least one action card selected from the first group of action cards as a subsequent first action, playing at least one corresponding reply action card selected from the second group of action cards in response to the subsequent first action and determining the result of playing each action card as a first action and each corresponding reply action card; and selecting a judgment card from a third group of cards to determine an outcome when one of (1) the indication of relative strength on a selected action card played as a first action is greater than the indication of strength on a selected correspondingly played reply action card played in response to the first action, and the distance of separation resulting from the indication of the movement distance and reach distance of each action card played as a first action and the indication of the movement distance of each corresponding played reply action card is greater than or equal to a predetermined distance, and (2) the indication of relative strength on a selected reply action card played in response to a first action is greater than the indication of strength on a selected first action card for which the selected reply action card was played, and the distance separation resulting from the indication of movement distance and the reach distance on each reply action card played in response to a first action and the indication of movement distance of each first action card for which each reply card was played is greater than or equal to a predetermined distance, each judgment card of the third group of cards including an indication of at least one of a successful play, an unsuccessful play and a penalty.

2. The method according to claim 1, wherein each action card further comprises an indication of a type of movement that is associated with the indication of movement distance, the indication of reach distance and the indication of relative strength.

3. The method according to claim 2, wherein the indication of the type of movement is one of an offensive movement and a defensive movement.

4. The method game according to claim 3, wherein each action card further comprises an indication of a direction of movement.

5. The method according to claim 4, wherein at least one of an action card and a reply card comprising a narrative instruction relating to at least one indication of the action card.

6. The method according to claim 5, wherein the method simulates a fencing bout.

7. The method according to claim 5, wherein the method simulates a boxing match.

8. The method according to claim 5, wherein the method simulates a martial arts match.

9. The method according to claim 8, wherein the simulated martial arts match comprises one of a simulated judo match, a simulated karate match, and a simulated Tae Kwan Do match.

10. A method of playing a card game, the method comprising:

providing a physical group of action cards;

forming a first group of action cards and a second group of action cards from a master group of action cards;

playing at least one action card selected from the first group of action cards, each action card played being selected from the first group of action cards and being played as a first action, and each action card selected from the first group of action cards comprising at least one of an indication of a required movement distance for the first action, an indication of a reach distance for the first action and an indication of a relative strength of the first action;

playing at least one reply action card selected from the second group of action cards in response to a total number of action cards played for the first action, each reply action card comprising at least one of an indication of a required movement distance for the reply action, an indication of a reach distance for the reply action and an indication of a relative strength of the reply action in response to the first action; and determining a result of playing each first action card and each corresponding reply action card, the result being based on at least one of (1) a distance of separation resulting from the indication of the movement distance of each action card played as the first action and the indication of the movement distance of each reply action card played in response to the first action, (2) the indication of the reach distance on a selected action card played as the first action, (3) the indication of the reach distance on a selected reply action card played in response to the first action, and (4) a difference in the indication of the relative strength of a selected action card played as the first action and the indication of the relative strength on a selected reply action card played in response to the first action.

11. The method according to claim 10, further comprising repeatedly playing at least one action card selected from the first group of action cards as a subsequent first action, playing at least one corresponding reply action card selected from the second group of action cards in response to the subsequent first action and determining the result of playing each action card as a first action and each corresponding reply action card.

12. The method according to claim 11, further comprising providing a physical group, of judgment cards; and selecting a judgment card from a third group of cards to determine an outcome when one of (1) the indication of relative strength on a selected action card played as a first action is greater than the indication of strength on a selected correspondingly played reply action card played in response to the first action, and the distance of separation resulting from the indication of the movement distance and the reach distance of each action card played as a first action and the indication of the movement distance of each corresponding played reply action card is greater than or equal to a predetermined distance, and (2) the indication of relative strength on a selected reply action card played in response to a first action is greater than the indication of strength on a selected first action card for which the selected reply action card was played, and the distance separation resulting from the indication of movement distance and the reach distance on each reply action card played in response to a first action and the indication of movement distance of each first action card for which each reply card was played is greater than or equal to a predetermined distance, each judgment card of the third group of cards including an indication of at least one of a successful play, an unsuccessful play and a penalty.

13. The method according to claim 12, wherein each action card further comprises an indication of a type of movement that is associated with the indication of movement distance, the indication of reach distance and the indication of relative strength.

14. The method according to claim 13, wherein the indication of the type of movement is one of an offensive movement and a defensive movement.

15. The method game according to claim 14, wherein each action card further comprises an indication of a direction of movement.

16. The method according to claim 15, wherein determining the result of playing each first action card and each corresponding reply action card is based on an initial separation distance of a predetermined number of distance units.

17. The method according to claim 16, wherein at least one action card comprises a narrative instruction relating to at least one indication of the action card.

18. The method according to claim 17, wherein the method simulates one of a fencing bout, a boxing match and a martial arts match.

19. The method according to claim 18, wherein the simulated martial arts match comprises at least one of a simulated judo match, a simulated karate match and a simulated Tae Kwan Do match.

* * * * *